US005535565A

United States Patent [19]

Majnaric et al.

[11] Patent Number: 5,535,565

[45] Date of Patent: Jul. 16, 1996

[54] CONTAINMENT STRUCTURE AND METHOD OF MAKING SAME

[75] Inventors: Anton B. Majnaric, Copley; William M. Bjerke, Hudson, both of Ohio

[73] Assignee: Majnaric Technologies, Inc., Copley, Ohio

[21] Appl. No.: 313,902

[22] Filed: Sep. 28, 1994

[51] Int. Cl.[6] ..... E04B 2/00

[52] U.S. Cl. ..... 52/426; 52/415; 52/425; 249/192; 249/216; 249/45; 249/78

[58] Field of Search ..... 52/415, 418, 421, 52/424, 425, 426, 428, 429, 479; 249/45, 78, 129, 192, 193, 216

[56] References Cited

U.S. PATENT DOCUMENTS

| | | | |
|---|---|---|---|
| 1,482,434 | 2/1924 | Hotchkiss | 249/192 |
| 2,763,048 | 9/1956 | Sullivan | 249/193 |
| 3,481,093 | 2/1969 | Davidson | 52/426 X |

*Primary Examiner*—Creighton Smith

*Attorney, Agent, or Firm*—Renner, Kenner, Greive, Bobak, Taylor & Weber

[57] ABSTRACT

A containment structure and a method for making such structure requires the implementation of a plurality of a minimum of building elements. A plurality of panels are interconnected by connector columns in stacked relationship to generate a dual walled shell, adapted to receive concrete between the inner and outer walls thereof. Rebar and other appropriate reinforcing material may be appropriately positioned before the concrete is poured. Additionally, before pouring of the concrete, the mating connections of the panels and column connectors are fused together by the passing of electrical current through conductors received within such elements at their points of interconnection. The rising temperature melts the material of which the panels and column connectors are fabricated, causing them to fuse together. In one embodiment of the invention, a foam barrier is provided on either side of the resultant concrete cylinder. The foam is later removed by mechanical or chemical techniques and replaced with lead to achieve a containment structure for radioactive waste.

18 Claims, 8 Drawing Sheets

CONTAINMENT STRUCTURE AND METHOD OF MAKING SAME

TECHNICAL FIELD

The invention herein relates to building structures and, more particularly to containment or storage buildings. Specifically, the invention relates to such a building structure which may be easily assembled with a minimal assortment of duplicative building components and wherein forms used to pour concrete or other construction media form an integral part of the final building.

BACKGROUND ART

Presently, there is a significant need for containment and storage facilities for receiving and maintaining hazardous waste—that material deemed harmful to the environment and its inhabitants. Such containment structures are necessary to prevent such waste from entering either the atmosphere above or the surrounding earth below. In that regard, such structures must be air and liquid tight, preventing such undesired escape. No known structure is given to ease of construction while providing an environmentally sound containment structure.

There is a further need in the art for storage and containment structures of a general nature. Indeed, there is an ever present need for such storage and containment structures which may be easily constructed of a minimal number of parts and with a reduction in labor requirements over previously known structures. It is, of course, desired that such a building be structurally sound and require minimal maintenance and care. Indeed, such a structure may be attained, as the invention will disclose, through the fabrication of a concrete structure in which the forms used for practicing the construction technique remain as an integral part of the finished structure.

DISCLOSURE OF INVENTION

In light of the foregoing, it a first aspect of the invention to provide a containment structure which is easy to construct.

Another aspect of the invention is to provide a containment structure which requires a minimal number of pieces in the fabrication process.

Still a further aspect of the invention is the provision of a containment structure which is constructed of reinforced concrete.

An additional aspect of the invention is the provision of a containment structure which is air and liquid tight to contain hazardous wastes and the preclude their escape to the environment.

Still a further aspect of the invention is the provision of a containment structure in which concrete is contained by forming pieces which remain in tact when the construction is completed.

Another aspect of the invention is the provision of a containment structure in which the forming pieces are fused together, to further achieve an air and water tight structure.

Yet another aspect of the invention is the provision of a containment structure which provides for lead shielding for receipt and maintenance of radioactive waste.

The foregoing and other aspects of the invention which will become apparent as the detailed description proceeds are achieved by a building structure, comprising: an inner wall formed of a first plurality of panels joined together along lateral edges thereof by first column connectors, said inner wall forming a closure; an outer wall formed of a second plurality of panels joined together along lateral edges thereof by second column connectors, said outer wall forming a closure about said inner wall; and means interposed between said inner and outer walls for defining a rigid structure therebetween.

Additional aspects of the invention which will become apparent herein are achieved by a method for erecting a building structure, comprising: interconnecting a first plurality of panels to each other along lateral edges thereof by interconnecting such panels with first column connectors to form a first layer of a first closure; interconnecting a second plurality of panels to each other along lateral edges thereof by interconnecting such panels with first column connectors to form a second layer of said first closure, said panels of said second layer being positioned atop said panels of said first layer and said column connectors of said second layer being positioned atop said column connectors of said first layer; and bonding said first column connectors to said lateral edges of associated panels.

DESCRIPTION OF DRAWINGS

For a complete understanding of the objects, techniques, structure, and method of the invention, reference should be had to the following detailed description and accompanying drawings wherein.

BEST MODE FOR CARRYING OUT THE INVENTION

Figure 1:
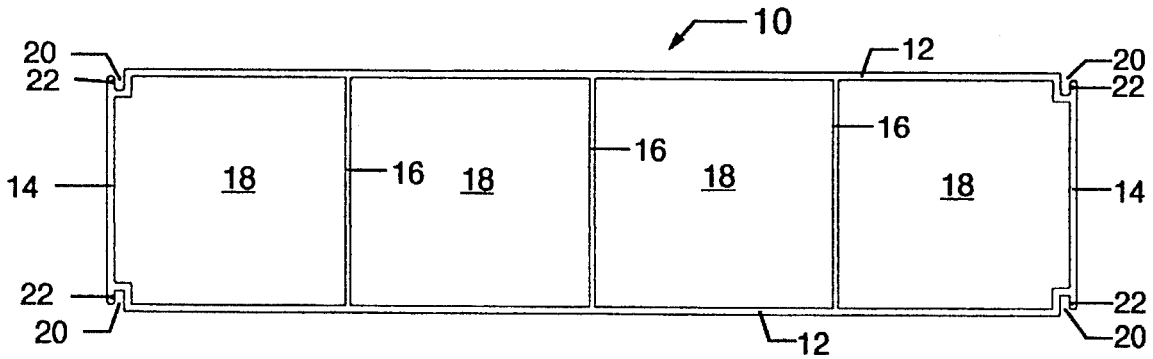
FIG. 1 is a cross sectional view of a panel used in accordance with the invention.

For an appreciation of the structure and technique of the invention, attention should first be made to the construction elements employed in achieving the final building structure. To this end, reference is first made to FIG. 1, wherein a panel according to the invention is designated generally by the numeral 10. It will be appreciated that the panel 10 is an elongated member and may be constructed of various sizes. In the preferred embodiment of the invention, the panel 10 is molded or extruded of a suitable synthetic material such as poly vinyl chloride (PVC) or other non-corrosive and non-deteriorating material. The panel 10 comprises a pair of opposed parallel face plates 12 interconnected at their ends by end webs 14. Internal webs 16 extend across the span between the face plates 12 and are interconnected orthogonally thereto. Accordingly, a plurality of elongated cavities 18 of rectangular or square cross section are defined between the various webs 14, 16.

A channel connector 20 is formed at each of the corners of the panel 10 at the intersection of the face plates 12 and the end web 14. Provided at each channel connector 20 and at opposite ends of each of the end webs 14 is a thermal conductor 22 which in the preferred embodiment comprises a copper wire, heating element, or other suitable member which generates heat in response to electrical current passing therethrough. It will be appreciated that each of the conductors 22 extends the entire length of the panel 10 and is exposed, as shown, at each of the opposite ends thereof.

Figure 2:
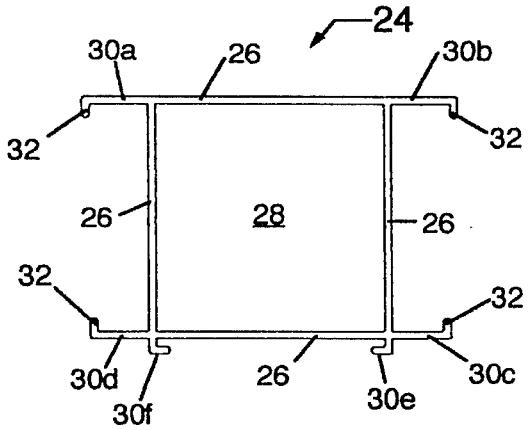
FIG. 2 is a cross sectional view of an outer ring column connector according to the invention.

A column connector 24 is shown in FIG. 2 and should be understood as also being an elongated member, typically having a length equal to the length of the panels 10. Column connector 24 is also preferably fabricated of the same material as the panel 10 and comprises four side plates 26 defining a cavity 28, as shown. While the side plates 26 are shown as being of equal size to provide a cavity 28 of square cross section, it will be appreciated that any generally rectangular configuration is suitable. An L-shaped connector leg 30 a–d extends from each of the corners of the column connector 24, with the connectors being turned inwardly toward each other in pairs as shown in FIG. 2, defining a channel thereby. Also extending from a pair of opposite corners of the column connector 24 are L-shaped connector legs 30 *e–f*, also being turned inwardly toward each other, as shown. Each of the L-shaped connector legs 30 *a–d* is provided with an electrical conductor or heater element 32, similar in nature to the element 22 of the panel 10 discussed above. Again, the conductors 32 extend the entire length of the L-shaped connector legs 30 *a–d*.

Figure 3:
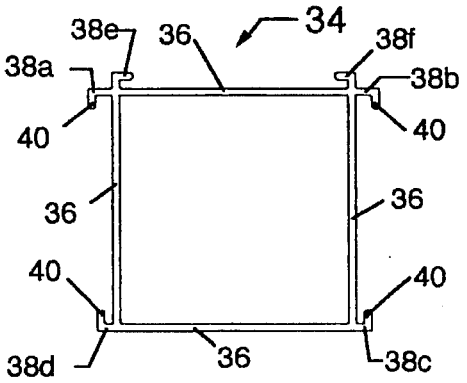
FIG. 3 is a cross sectional view of an inner ring column connector as employed in the invention.

It will be appreciated that the L-shaped connector legs 30 *a–d* of the column connector 24 are of an elongated L-shaped nature. As will be appreciated below, this configuration is provided to allow the column connectors 24 to serve as outer ring connectors in an ultimate dual-walled cylindrical structure of circular cross section. In like manner, and as shown in FIG. 3, column connectors 34 are provided to interconnect the various panels 10 in the inner wall structure of the dual-walled building to be discussed below. Here, each column connector 34 is formed by a plurality of side plates 36, again defining a cavity 28. As presented above, the side plates 26 may be of identical size and configuration to provide the cavity 28 of square cross section, but any generally rectangular cross section will suffice. L-shaped connector legs 38 *a–d* extend from opposite corners of the column connector 34 and are turned inwardly as shown. In similar fashion, L-shaped connector legs 38 *e–f* are also provided extending along the side of one of the face plates 36. It will again be appreciated that the column connector 24, adapted for interconnecting panels 10 in the inner ring of a dual wall configuration, have the same length as the panels 10. Finally, electrical conductors 40 are provided in the ends of each of the L-shaped connector legs 38 *a–d* and are of the same nature as the conductors 22, 32 discussed above.

As mentioned above and as will become apparent below, the column connectors 24 serve to interconnect panels 10 in an outer wall while the column connectors 34 serve to connect panels 10 in an inner wall of a dual walled structure. In the event that the structure is of square or rectangular configuration, the legs 30 *a–d* will typically be identical to the legs 38 *a–d*. However, if the resultant building is to be of circular cross section such as a silo or the like, the legs 30*a*, 30*b* and 38*a*, 38*b* will typically be longer than the corresponding legs 30*c*, 30*d* and 38*c*, 38*d*. Specifically, the column connector 34 of FIG. 3 is shown in that configuration. The column connector 24 of FIG. 2 is shown with legs 30 *a–d* all of the same length, as would be expected in a building structure of flat or linear walls. Those skilled in the art will readily appreciate that the disparity in length between the pairs of legs on the column connectors 24, 34 will be dependent upon the radius of curvature of the resultant cylindrical building.

Figure 4:
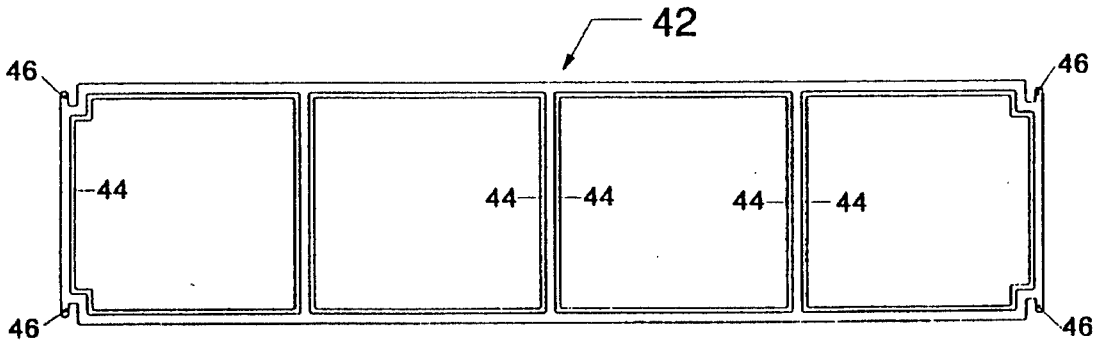
FIG. 4 is a top plan view of a panel joint gasket used in accordance with the invention.

With reference now to FIG. 4, it will be noted that a gasket 42 is provided for interposition between vertically stacked panels 10. In the preferred embodiment of the invention, the gasket 42 is formed of rubber, vinyl, or other suitable polymeric material which is substantially impervious to deterioration, shrinkage, or the like. The gasket 42 is provided with ribs 44 which extend both above and below the plane of the gasket and are provided to matingly engage over the top surfaces of the corresponding elements of the panel 10. In other words, ribs 44 would pass above and below on either side of the inner webs 16, outer web 14, and face plates 12 of the panel 10, as will be appreciated below. Again, a conductive member such a wire, or an appropriate heating element 46 is provided at each of the corners of the gasket 42, as shown. The conductors 46 are adapted to electrically interconnect with the conductors 22 of the panels 10.

Figure 5:
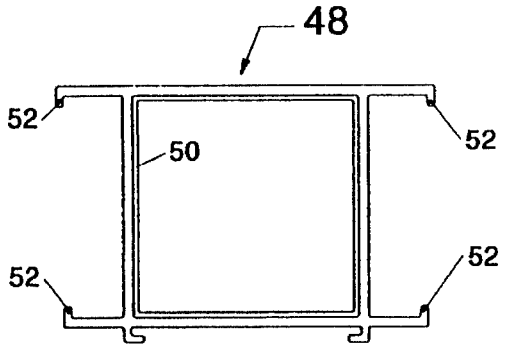
FIG. 5 is a top plan view of a joint gasket used in association with an outer ring column connector in accordance with the invention.

FIG. 5 illustrates a gasket 48 adapted for use with the column connector 24. Again the gasket 48 is made of an appropriate elastomeric material and includes a rib 50 extending above and below the plane of the gasket to be matingly received within the cavity 28 along side the inner surfaces of the side plates 26. Conductors 52 are also provided for making electrically conductive engagement with the conductors 32.

Figure 6:
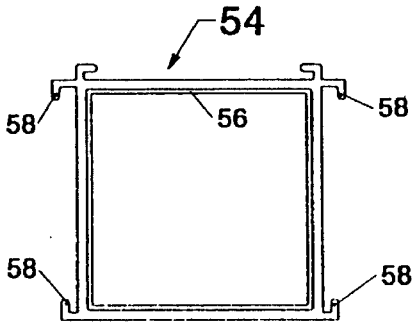
FIG. 6 is a top plan view of a gasket employed with an inner ring column connector according to the invention.

A gasket 54 adapted for use with the column connector 34 is shown in FIG. 6. Again, the gasket is of an appropriate elastomeric material and includes a rib 56 extending above and below the plane of the gasket. The rib 56 is adapted for receipt within the cavity 28 defined by the side plates 26 and to engage along the side thereof. As with the gasket 48, electrical conductors 58 are provided to conductingly engage with the conductors 40.

Figure 7:
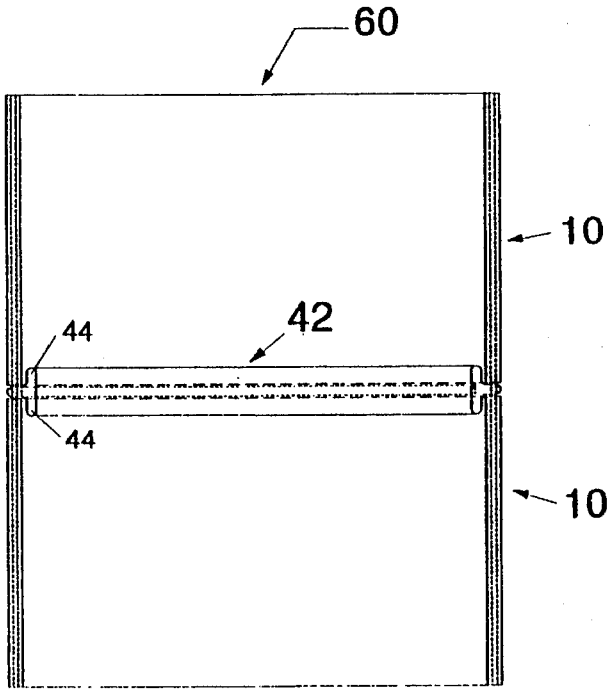
FIG. 7 is an illustrative cross sectional view of a pair of panels atop each other with a gasket interposed therebetween.
Figure 8:
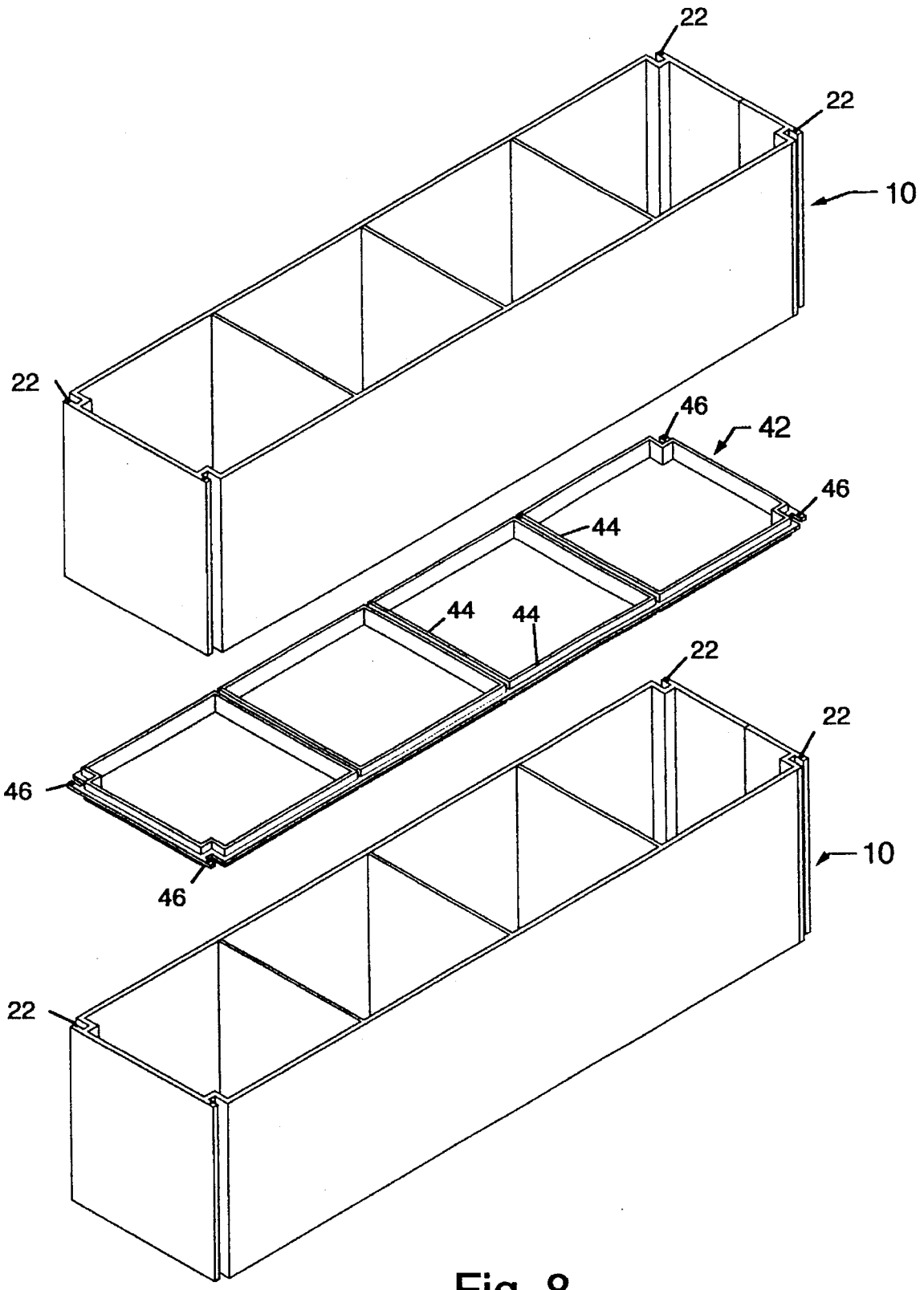
FIG. 8 is an exploded view of a pair of panels with a gasket interposed therebetween.

The implementation of a gasket 42 interposed between a pair of stacked panels 10 is illustrated in cross section by the numeral 60 in FIG. 7 and is further shown in assembly view in FIG. 8. It should be readily appreciated that the gasket 42 nests upon the bottom one of the panels 10 and nestingly receives the lower edge of the top panel 10. Accordingly, an airtight and water fight engagement is achieved between the vertically stacked panels 10, as would also be achieved between the vertically stacked column connectors 24, 34 when employing associated gaskets 48, 54.

Figure 9:
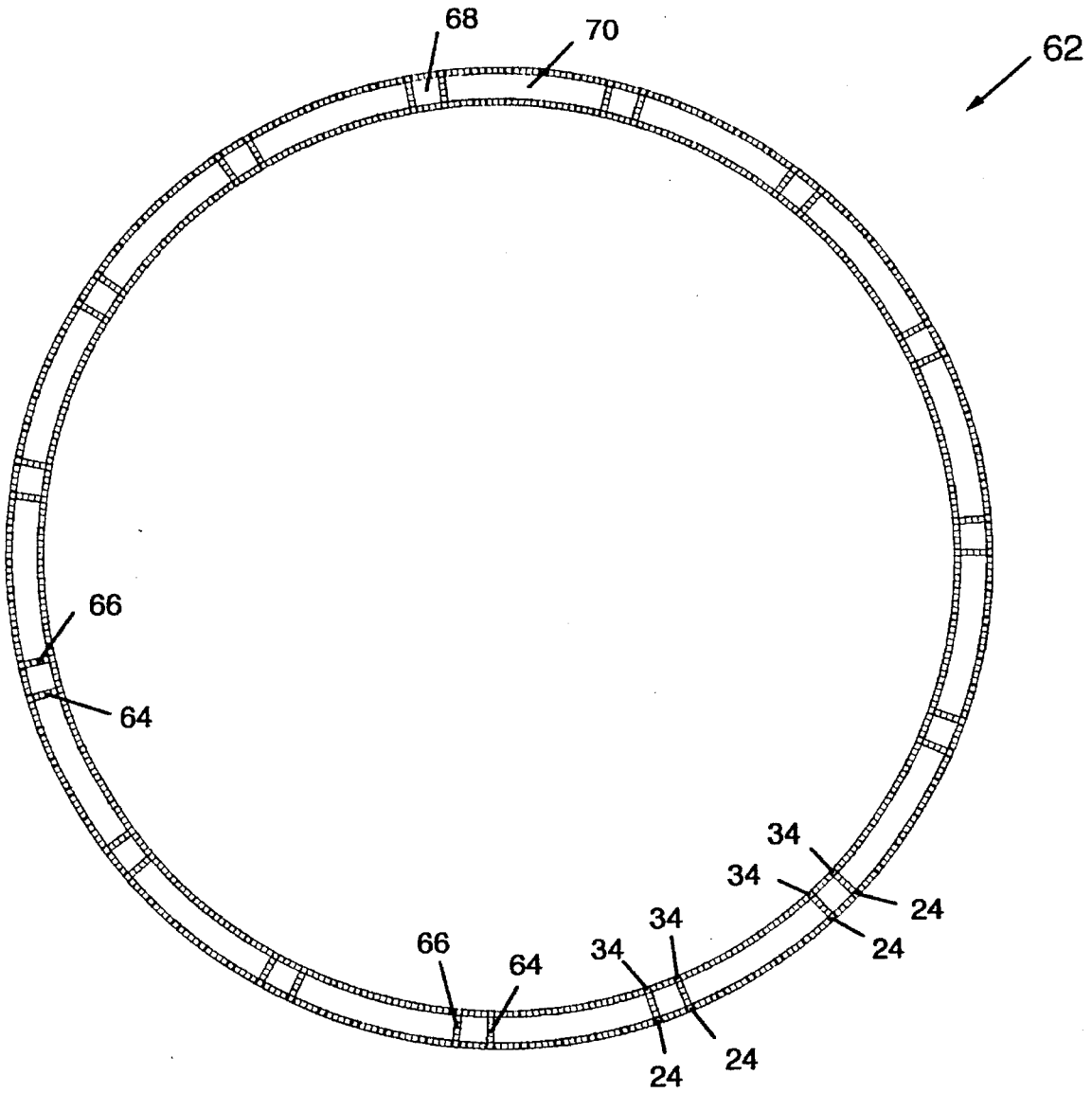
FIG. 9 is a top plan view of an assembled cylindrical structure made in accordance with the invention employing the construction elements presented in FIGS. 1–8.

With reference now to FIG. 9, it can be seen that the circular cross section of a cylindrical building frame made in accordance with the invention is designated by the numeral 62. It will be appreciated that the building frame 62 comprises a plurality of stacked and interconnected panels 10 and outer and inner column connectors 24, 34. As shown in FIG. 9, the building frame 62 is a dual walled structure formed of a plurality of interconnected panels 10, joined together on the inner wall by the inner panel connectors 34, and at the outer wall by the outer column connectors 24. As further illustrated, sectors of six interconnected panels 10 are defined between cross panels 64, 66. It will be appreciated that each of the cross panels 64, 66 also comprises a stacked arrangement of the panels 10. As will readily be appreciated, the panels 10 forming the inner wall section are connected together by means of the column connectors 34, while the panels 10 forming the outer wall section are interconnected by the column connectors 24. At the points where the cross panels 64, 66 are positioned, a panel 10 is interconnected between the L-shaped connector legs 30*e* and 30*f* of the outer column connector 24, and the L-shaped connector legs 38*e* and 38*f* of the inner wall column connector 34. It should further be appreciated that the building frame 62 is thus defined by a plurality of column cavities 68 defined between the cross panels 64, 66 and arcuate cavities 70 also similarly defined. The column cavities 68 have a width of one panel 10, while the arcuate cavities 70 have a width of six such panels.

Figure 10:
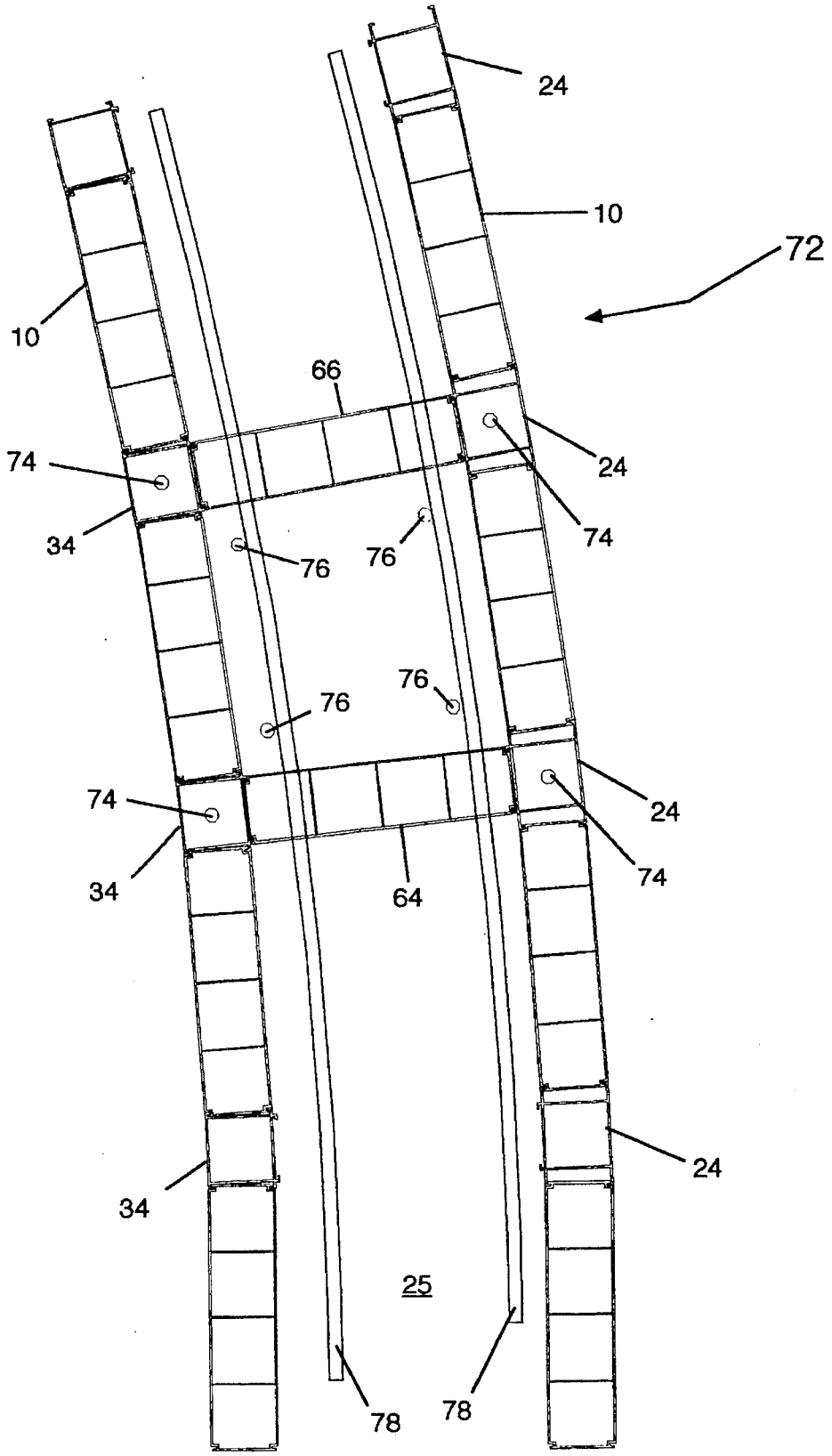
FIG. 10 is a top plan view in partial section, illustrating a portion of a circular building structure showing the implementation of the panels and connectors with rebar placed reinforcement of the resulting concrete structures.

It should further be appreciated from reference to FIG. 9 that a cylindrical housing 62 can be fabricated using a plurality of interconnected rectangular or square building panels 10 and column connectors 24, 34. Curvature is obtained by control of the disparity in length of the L-shaped connector legs 30*a*–30*d* of the outer column connector 24, and the similar legs 38*a*–38*d* of the inner column connectors With reference now to FIG. 10, it can be seen that a section of the inner and outer walls of the building frame 62 is designated generally by the numeral 72. Here, the positioning of the outer wall column connectors 24 with respect to the inner wall column connectors 34 is shown. Additionally, positioning of the cross members 64, 66, which simply comprise stacked panels 10, can also be seen. Of particular importance to the concept of the invention, it will be noted that rebar 74 is positioned vertically in the column connectors 24, 34 at the cross members 64, 66. Additionally, it will be appreciated that rebar 76 may be vertically positioned within the cavity defined between the cross members 64, 66 as illustrated. Finally, rebar 10 78 may be arcuately extended horizontally in the region between the inner and outer walls of the building frame 62 as shown. Finally, the various cavities defined by the inner and outer walls are filled with an appropriate hard-setting material such as concrete. First, the cavities 18 of the panels 10 and the cavities 28 of the column connectors 24, 34 forming the inner and outer walls are filled with concrete, thereby establishing rigid concentric cylindrical forms for the larger central cavities 68, 70, which are subsequently poured. For added strength of the forms, the cavities 18 of the panels 10 forming the cross members 64, 66 may be filled with concrete at the time of pouring those of the inner and outer walls. However, pouring of the cross members 64, 66 may be delayed until pouring of the cavities 68, 70. It will, of course, be appreciated that the entire building structure 62 will typically set upon an appropriate pad or the like with certain of the rebar 74, 76 extending therefrom.

Figure 11:
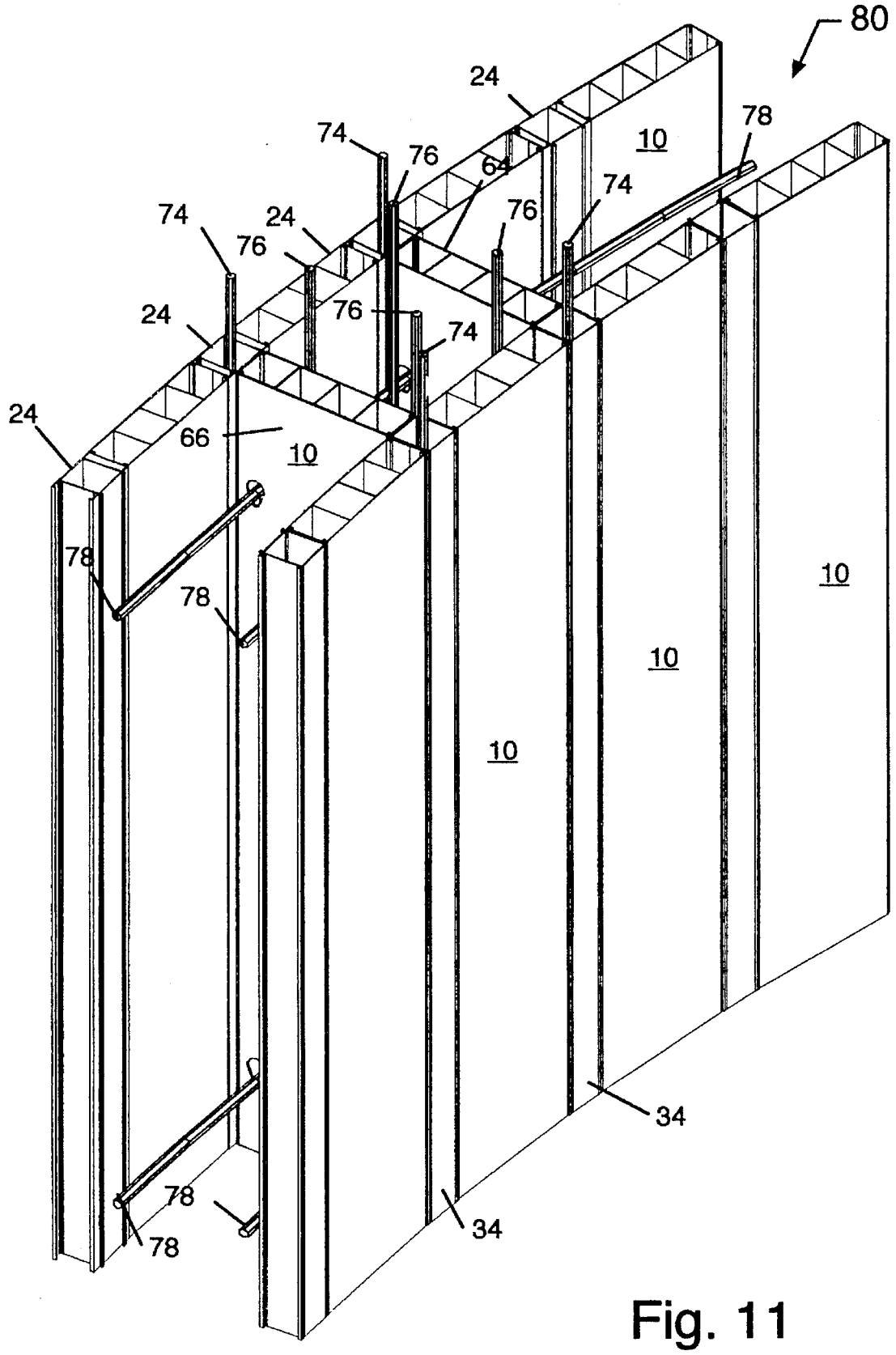
FIG. 11 is an isometric view of a portion of an assembled circular structure made in accordance with the invention.

With reference now to FIG. 11, it can be seen that a section of a building structure 62 is designated generally by the numeral 80. Here, the positioning of the rebar 78 arcuately between the wall sections is clearly shown, as is the extension of the vertically positioned rebar 74, 76.

It should further be appreciated that the joints between the panels 10 and the column connectors 24, 34 can be fused and integrally bonded by an appropriate means such as heating the material of the channel connectors and column connectors. For this purpose, the forming elements of the structure, such as the panels 10 and connectors 24, 34 are fabricated of an appropriate fusible material such as a synthetic on the order of PVC or the like. By passing current through the various conductors 22, 32, 40, 46, 52, and 58, the temperature of the material surrounding the conductors may be raised to such a point as to begin to melt or flow. When the current is terminated, the temperature of the conductor decreases to ambient, allowing the synthetic material to reset in a fused or bonded condition. Of course, other fusing or bonding techniques may be employed, such as the use of light, vibration, or other means to generate the necessary heat to achieve the thermal bond. The bonding or fusing operation causes the entirety of the forms 10, 4, 34 to become an integral shell providing, in combination with the gaskets 42, 48, 54 a dual walled airtight and water tight structure. Indeed, four concentric sealed integral cylindrical barriers are thereby formed. Completion of that structure is then achieved by the pouring of concrete in appropriate cavities as discussed above.

It is further contemplated as a portion of the invention that the horizontally oriented gaskets 42 interposed between the panels 10 of the outer walls of the structure 62 be vertically spaced from or misaligned with the corresponding gaskets 42 of the inner wall thereof. This precludes horizontal joints from being aligned between the walls of the structure. Such misalignment may be easily achieved by simply interposing panels of different lengths or heights in selected rows of such panels in either the inner or outer wall structure.

Figure 12:
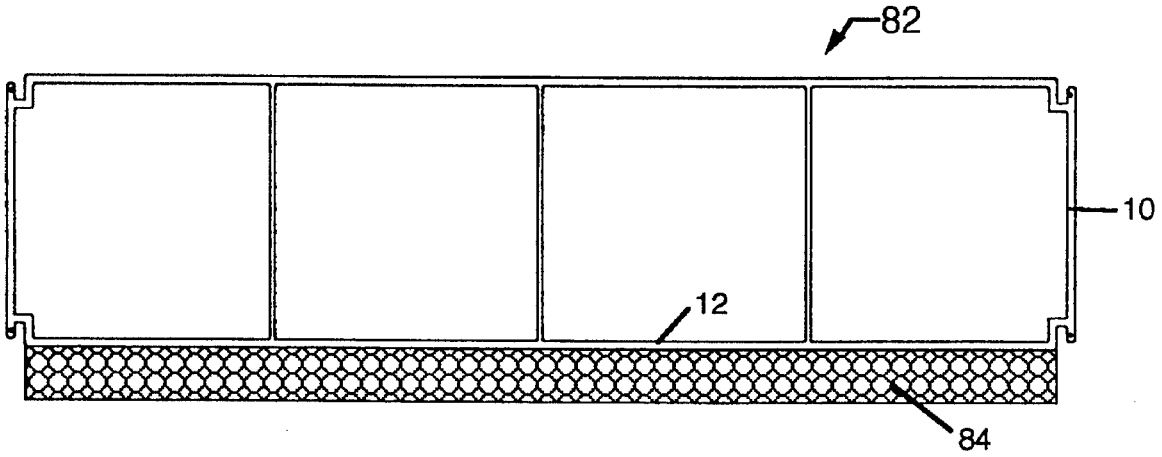
FIG. 12 is a cross sectional view of a panel according to the invention having foamed material laminated to one external face.

It is also contemplated as a portion of the instant invention that a suitable housing or structure may be developed to receive radioactive waste. In this regard, it is desired that an appropriate lead shielding be present about the entire perimeter of the containment structure. In this regard, reference is now made to the structure shown in FIGS. 12–16. In FIG. 12, a wall panel 82 is shown as comprising the previously referenced wall panel 10 having an appropriate layer of foam 84 laminated to an outer one of the face plates 12. As will be appreciated herein, each of various forming and construction elements is provided with such a foam layer, which foam may be any appropriate close cell foam.

Figure 13:
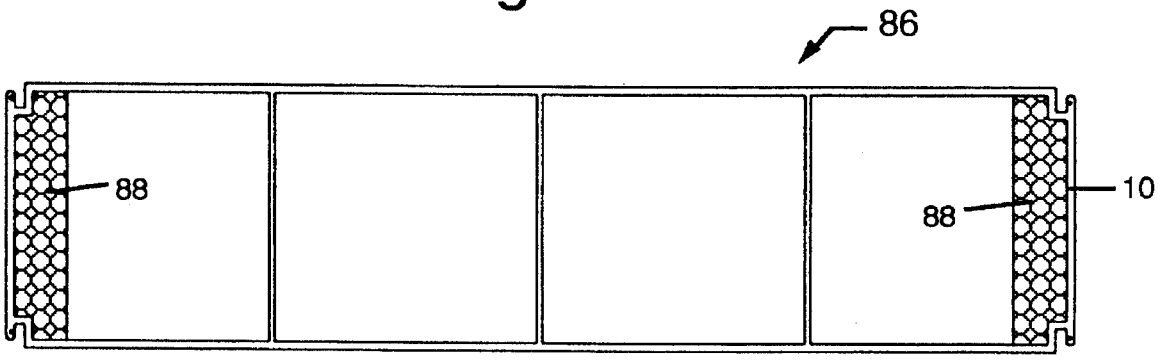
FIG. 13 is a cross sectional view of a panel according to the invention having a foamed material laminated to the interior of each end.
Figure 14:
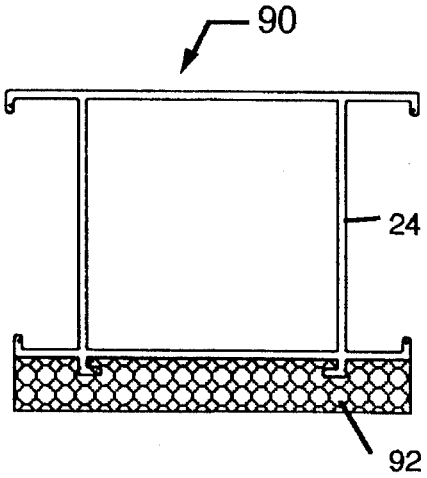
FIG. 14 is a cross sectional view of an outer ring column connector according to the invention having a foamed material laminated to one external face.
Figure 15:
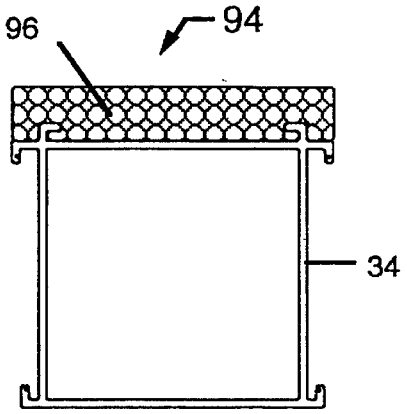
FIG. 15 is a cross sectional view of an inner ring column connector according to the invention having a foamed material laminated to one external face.

With reference to FIG. 13, it can be seen that a panel 86 consists of the previously described panel 10 having a foam layer 88 laminated on an inner surface of each of the end webs 14 thereof. In like manner, FIG. 14 illustrates an outer ring column connector 90 having a foam layer 92 laminated to an outer surface thereof, while FIG. 15 illustrates an inner ring column connector 94 having a foam layer 96 laminated to an outer surface thereof. It will be appreciated that the column connector 90 is simply the column connector 24 with a foam layer laminated thereto, while the column connector 94 is simply a column connector 34 with a foam layer 96 laminated thereto.

Figure 16:
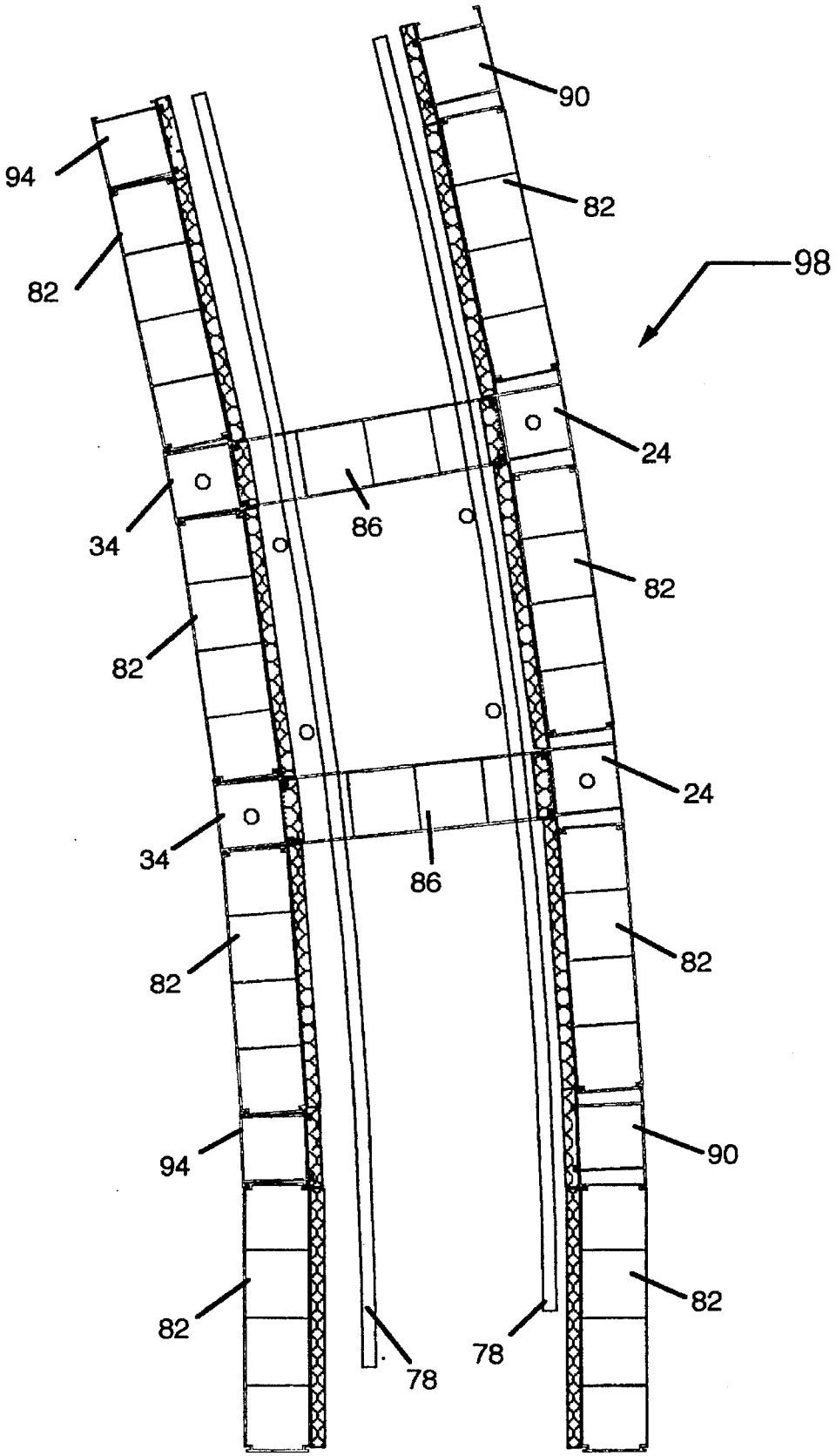
FIG. 16 is a top plan view in partial section, showing the utilization of the elements of FIGS. 12–15 in a building structure.

The elements 24, 34, 82, 86, 90 and 94 may be employed in the manner described earlier herein to construct a cylindrical containment housing such as that shown in FIG. 9. The exact positioning of the various building elements is illustrated in FIG. 16. As illustrated, panels 86 are employed to form the cross members between the inner and outer walls, mating with standard outer and inner column connectors 24, 34, as illustrated. The panels 82 forming the inner wall are joined together with the inner column connectors 94, while the panels 82 forming the outer wall are joined together with the column connectors 90. The section 98 shown in FIG. 16 is, of course, repeated throughout the entire structure to achieve the desired cylindrical housing. Rebar is similarly employed as discussed earlier herein and the cavity between the inner and outer walls is filled with concrete.

It will now be appreciated that a cylindrical concrete wall has been developed with a foam barrier interposed between the inner and outer wall shells. It is then contemplated that the foam layers are removed, either mechanically or chemically as by pouring an appropriate acid upon the foam, thus leaving a void between the concrete cylinder and the cylinder housing formed by the panels 82 and column connectors 90, 94, 24, 34. The void may then be filled with lead as by pouring the lead into the cavity to provide a double wall thickness of lead on either side of the concrete cylinder. By presenting lead also in the bottom of the building structure and providing the structure with a lead cap, a containment housing having a lead barrier about the entirety thereof is thus defined. Such a structure is suitable for receiving and retaining radioactive material and waste.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A building structure, comprising:

an inner wall formed of a first plurality of panels joined together along lateral edges thereof by first column connectors, said inner wall forming a closure;

an outer wall formed of a second plurality of panels joined together along lateral edges thereof by second column connectors, said outer wall forming a closure about said inner wall, wherein said first and second column connectors comprise elongated members having a leg extending from each of four corners thereof, each leg engaging one of said channel connectors; and means interposed between said inner and outer walls for defining a rigid structure therebetween.

2. The building structure according to claim 1, wherein each said panel comprises a pair of parallel interconnected face plates having pairs of channel connectors extending along each of two vertical ends thereof.

3. The building structure according to claim 2, wherein said inner and outer walls are formed from vertically stacked and aligned panels respectively interconnected with vertically stacked and aligned first and second column connectors.

4. The building structure according to claim 2, further comprising gaskets interposed between each of said vertically stacked and aligned panels and between each of said vertically stacked and aligned column connectors.

5. The building structure according to claim 4, wherein said channel connectors of said panels and said legs of said column connectors are of a heat fusible material.

6. The building structure according to claim 4, wherein each of said channel connectors and legs of said column connectors has an electrical conductor passing therethrough, said electrical conductors heating and melting said heat fusible material of associated channel connectors and legs of said column connectors in response to electrical current passing therethrough.

7. The building structure according to claim 3, wherein pairs of legs of said column connectors are of different lengths, such difference in lengths defining a radius of curvature of said inner and outer walls.

8. The building structure according to claim 7, wherein said legs of said pairs of legs of said column connectors closer to an interior of said closure are shorter then said legs of said pairs of legs of said column connectors further from said interior.

9. The building structure according to claim 3, further comprising panels extending between said inner and outer walls between selected ones of said first and second column connectors.

10. The building structure according to claim 9, wherein said first and second column connectors each have an additional leg extending from each of two corners thereof, said additional legs engaging channel connectors on opposite sides of said panels extending between said inner and outer walls.

11. The building structure according to claim 10, further comprising rebar extending between said first and second walls.

12. The building structure according to claim 11, further comprising rebar received within certain of said column connectors.

13. The building structure according to claim 12, wherein said means interposed between said inner and outer walls comprises concrete.

14. A method for erecting a building structure, comprising:

interconnecting a first plurality of panels to each other along lateral edges thereof by interconnecting such panels with first column connectors to form a first layer of a closure;

interconnecting a second plurality of panels to each other along lateral edges thereof by interconnecting such panels with first column connectors to form a second layer of said closure, said panels of said second layer being positioned atop said panels of said first layer and said column connectors of said second layer being positioned atop said column connectors of said first layer; and bonding said first column connectors to said lateral edges of associated panels by heat fusing.

15. The method according to claim 14, further comprising the steps of:

interconnecting a third plurality of panels to each other along lateral edges thereof by interconnecting such panels with second column connectors to form a first layer of a second closure in juxtaposition to said first layer of said first closure;

interconnecting a fourth plurality of panels to each other along lateral edges thereof by interconnecting such panels with second column connectors to form a second layer of said second closure, said panels of said first layer of said second closure and said column connectors of said second layer of said second closure being positioned atop said column connectors of said first layer of said second closure; and bonding said second column connectors to said lateral edges of associated panels by heat fusing.

16. The method according to claim 15, further comprising the step of pouring concrete in an area between said first and second closures.

17. The method according to claim 16, wherein said panels and said column connectors have a foam material fixed to certain surfaces thereof, said concrete being poured against said foam material.

18. The method according to claim 17, further comprising the step of removing said foam material following curing of said concrete and thereby creating a void, and subsequently filling said void with lead.

* * * * *